US006320507B1

(12) United States Patent
Strzelec et al.

(10) Patent No.: US 6,320,507 B1
(45) Date of Patent: Nov. 20, 2001

(54) METHOD FOR SYNCHRONIZATION BETWEEN SYSTEMS

(75) Inventors: Stanley Strzelec, Boca Raton; Brent Balch, Fort Lauderdale; Robert Lynch, Margate, all of FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/545,269

(22) Filed: Apr. 7, 2000

(51) Int. Cl.[7] ..... G08B 13/14

(52) U.S. Cl. ..... 340/572.1; 340/572.4; 340/10.1; 340/10.3; 340/310.04; 455/127

(58) Field of Search ..... 340/572.1, 572.4, 340/10.1, 10.3, 310.04, 310.01; 455/127

(56) References Cited

U.S. PATENT DOCUMENTS 4,622,543 11/1986 Anderson, III et al. ..... 340/572.1
4,658,241 * 4/1987 Torre ..... 340/551
4,667,185 * 5/1987 Nourse et al. ..... 340/572
4,675,658 6/1987 Anderson et al. ..... 340/551
4,797,659 * 1/1989 Larsen ..... 340/572.1
5,023,600 6/1991 Szklany et al. ..... 340/572.1
5,051,727 * 9/1991 Fockens ..... 340/572.4
5,276,430 * 1/1994 Granovsky ..... 340/572.4
5,371,490 * 12/1994 Martinides ..... 340/572.4
5,995,002 * 11/1999 Fallin et al. ..... 340/505
6,118,378 * 9/2000 Balch et al. ..... 340/572.7
6,201,469 * 3/2001 Balch et al. ..... 340/10.1

* cited by examiner

*Primary Examiner*—Benjamin C. Lee
(74) *Attorney, Agent, or Firm*—Akerman, Senterfitt & Eidson, P.A.

(57) ABSTRACT

An apparatus for synchronized operation of a plurality of EAS systems. The system includes two or more EAS systems. Each EAS system has a receiver for receiving the same RF synchronization signal sent from a remote source, a transmitter for transmitting a marker exciter pulse and an exciter pulse receiver. The transmitter and exciter pulse receiver of each of the EAS systems are selectively enabled a predetermined time after receiving the RF synchronization signal so that all EAS systems in a localized area can be synchronized with one another.

21 Claims, 4 Drawing Sheets

METHOD FOR SYNCHRONIZATION BETWEEN SYSTEMS

CROSS-REFERENCE TO RELATED APPLICATIONS (Not Applicable)

BACKGROUND OF THE INVENTION

1. Field of the Invention

This invention relates to synchronization between systems. More specifically, this invention relates to the synchronization of electronic article surveillance systems through the use of an RF synchronization signal.

2. Description of the Relevant Art

Electronic Article Surveillance (EAS) systems are detection systems that allow the identification of a marker or tag within a given detection region. EAS systems have many uses, but most often they are used as security systems for preventing shoplifting in stores or removal of property in office buildings. EAS systems come in many different forms and make use of a number of different technologies.

A typical EAS system includes an electronic detection unit, markers and/or tags, and a detacher or deactivator. The detection unit is used to detect any active markers or tags brought within the range of the detection unit. The detection units can, for example, be bolted to floors as pedestals, buried under floors, mounted on walls, or hung from ceilings. The detection units are usually placed in high traffic areas, such as entrances and exits of stores or office buildings.

The markers and/or tags have special characteristics and are specifically designed to be affixed to or embedded in merchandise or other objects sought to be protected. When an active marker passes through the detection unit, the alarm is sounded, a light is activated, and/or some other suitable control devices are set into operation indicating the removal of the marker from the proscribed detection region covered by the detection unit.

Most EAS systems operate using the same general principles. The detection unit includes a transmitter, which is placed on one side of a detection region and a receiver, which is placed on the opposite side of this detection region. The transmitter sends a signal at defined frequencies across the detection region. For example, in a retail store the detection region is usually formed by placing the transmitter and receiver on opposite sides of a checkout aisle or an exit. When a marker enters the region, it creates a disturbance to the signal being sent by the transmitter. For example, the marker may alter the signal sent by the transmitter by using a simple semiconductor junction, a tuned circuit composed of an inductor and capacitor, soft magnetic strips or wires, or vibrating resonators. The marker may also alter the signal by repeating the signal for a period after the signal transmission is terminated by the transmitter. This disturbance caused by the marker is subsequently detected by the receiver through the receipt of a signal having an expected frequency, the receipt of a signal at an expected time, or both. As an alternative to the basic design described above, the receiver and transmitter units, including their respective antennas, can be mounted in a single housing.

One key concern with EAS systems from a design standpoint is ensuring that there is proper synchronization as between the transmitter and the receiver. For example, in many systems it is highly important that the transmitter window, during which time the transmitter transmits a marker exciter signal, does not overlap with the receiver window, during which the receiver is attempting to detect a marker response signal. In these systems, any overlap between these two windows will result in degradation of system performance. Typically, these two windows are separated by an off state during which neither the receiver or the transmitter is active.

Certain conventional EAS systems rely on a local power line current or voltage zero crossing for synchronization of the transmitter window and the receiver window. If there is no other EAS system in close proximity, then the actual position of the transmit and receive windows versus the power line zero crossing is not very important. However, when more than one such system is installed at a distance which allows the receiver of one system to receive a transmitter signal of another system, then the relative position of the transmit and receive windows in all systems becomes very important. Such a situation may occur for example when there are multiple exits which require separate EAS systems. If the power line zero crossings for all of the EAS systems happen at the same time then the transmit and receive windows of all of the EAS systems will be synchronized relative to one another. In that case, all windows are perfectly aligned, and there is no possibility that the transmitter pulse of one system will be seen in the receiver of another system. More often however, the various EAS systems are connected to different power line outlets, each having a unique power line phase shift related to the type of load on the power line. This phase shift can vary over time and can cause the transmit and receive windows of the various EAS systems to overlap, resulting in degraded performance or false alarming.

Prior art systems have made use of an off state to delay the time between the transmitter and receiver windows. This approach allows for a small phase shift between nearby EAS systems while still ensuring that there is no overlap between transmit and receive windows of the nearby systems. However, this is not an entirely satisfactory solution to the problem. This is partly due to the fact that time must be allowed for the transmitter to transition from an on state to an off state. In any case, significantly extending the off state to accommodate larger phase shifts between power line zero crossings is not practical because the signal from a tag or marker starts to decay as soon as the transmitter pulse is removed. Delaying the receiver window relative to the transmitter pulse reduces the received marker signal and therefore limits the range of detection for the system.

SUMMARY OF THE INVENTION

It is an object of the invention to provide a method and an apparatus for synchronizing electronic article surveillance (EAS) systems in close proximity to one another.

It is another object of the invention to provide a method and an apparatus for synchronizing EAS systems using an external source.

These and other objects of the invention are achieved by an apparatus for synchronizing an EAS system including a synchronization receiver for receiving in the EAS system an RF synchronization signal sent from a remote source; a transmitter that transmits an exciter pulse in response to the RF synchronization signal; and an exciter pulse receiver for detecting the identification marker when the identification marker has been excited. The apparatus of the present invention can also include a time difference detector for detecting a time difference between the RF synchronization signal and a zero crossing of the power line current or voltage for a power line attached to the EAS system.

In the present invention, the exciter pulse excites a remotely located identification marker found in a detection area of the EAS system. The excited identification marker has a characteristic response to the exciter pulse when the identification marker is within the detection area. The exciter pulse receiver is then enabled a predetermined time after the transmitter transmits the exciter pulse. If the identification marker has been excited by the exciter pulse, the exciter pulse receiver detects the characteristic response of the excited identification marker.

The transmitter transmits the exciter pulse a predetermined time after the RF synchronization signal is detected. If the synchronization receiver does not receive the RF synchronization signal, the transmitter transmits the exciter pulse at a predetermined amount of time following the zero crossing of the power line current or voltage of the EAS system. The predetermined amount of time is the previously measured difference between the time at which previous RF synchronization signals were received by the transmitter and the time at which the zero crossing of the power line current or voltage attached to the EAS system is detected by the time difference detector.

In the present invention, the remote source is preferably a radio transmitter system. The system can be a satellite or terrestrial radio transmitter transmitting a known time reference signal. The RF synchronization signal can be an absolute timing signal or a local timing signal. if the remote source is a satellite or terrestrial radio transmitter, the RF synchronization signal is preferably an absolute timing signal. Alternatively, the remote source can be a local timer. The local timing system can be independently generated, or it can be based on a designated power line reference signal. Furthermore, the RF synchronization signal is preferably encoded. In the present invention, it is preferable that the RF synchronization signal be received by multiple EAS systems.

In another embodiment of the present invention, a method for synchronizing EAS systems includes receiving in the EAS system an RF synchronization signal sent from a remote source; transmitting an exciter pulse for exciting a remotely located identification marker in response to receiving the RF synchronization signal; and, a predetermined time after transmitting the exciter pulse, enabling an exciter pulse receiver for detecting a characteristic response of the identification marker. The method may further include detecting a time difference between the RF synchronization signal and a zero crossing of a power line current or voltage. Furthermore, the method may also include selectively transmitting the exciter pulse a predetermined amount of time, equal to the measured time difference, after detecting the zero crossing, when the RF synchronization signal is not received.

In the present invention, when the RF synchronization signal is not received from the EAS system, a backup system is used to maintain synchronization. More particularly, when the RF synchronization is available, the system calculates time difference between the RF synchronization signal and a zero crossing of either a power line current or voltage. This time difference will be different for each EAS system being synchronized, and will be dependant upon the zero crossing of either of the current or voltage of the power line connected to the EAS system. This time difference is generally stored in a memory associated with each transmitter.

DETAILED DESCRIPTION OF THE INVENTION

Figure 1:
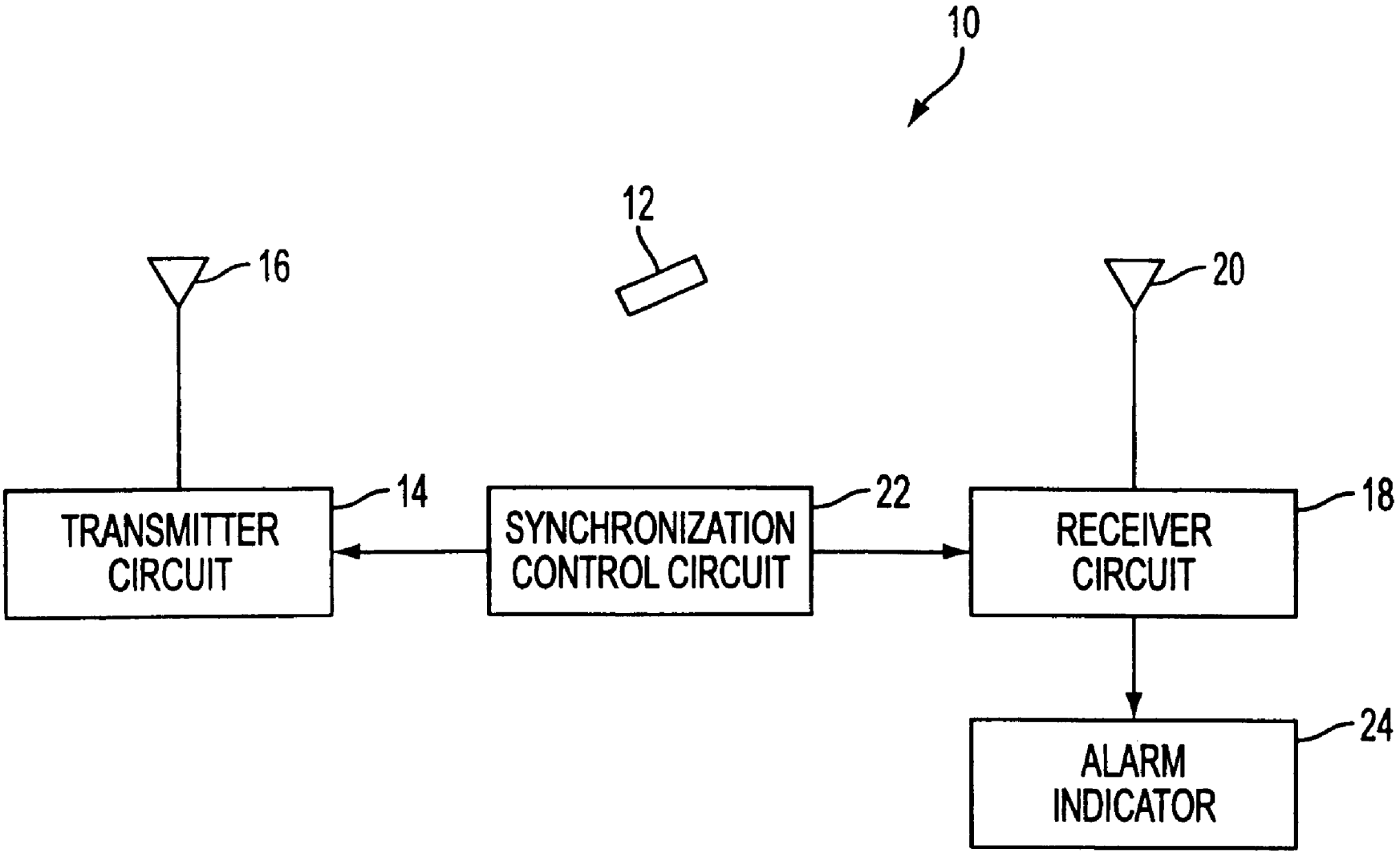
FIG. 1 is a block diagram of a surveillance system according to the invention.

FIG. 1 shows a single EAS system 10 which is responsive to the presence of a marker 12 within a detection zone. The EAS system includes a transmitter circuit 14 and antenna 16 for generating a transmitted signal in the form of a magnetic field or a desired frequency within the detection zone. A receiver circuit 18 is provided for detecting a characteristic response of the marker when exposed to the transmitted signal. The detection of marker 12 in this manner will result in the receiver circuit triggering a suitable response such as may be provided by alarm indicator 24.

Transmitter 14 is preferably any transmitter that can be used in an EAS system. One example of such a system is the Ultra.Max® system which is available from Sensormatic Electronics Corporation of Boca Raton, Fla. The transmitter 14 preferably transmits the exciter pulse at a predetermined time, relative to the receipt of the RF synchronization signal. In the present invention, the transmitter 14 preferably transmits the exciter pulse between 30 and 60 times per second. Furthermore, the exciter pulse preferably has a frequency of about 58 kHz. However, those skilled in the art will appreciate that the invention is not limited in this regard, and the exciter pulse can be transmitted more or less often, and on different frequencies depending upon a variety of factors including the types of markers used.

Similarly, the receiver circuit 18 that detects the characteristic response of an excited marker can be any of a variety of known conventional EAS receivers, including but not limited to the receiver which is used in the Ultra.Max® system as offered by Sensormatic Electronics Corporation.

The marker 12 can be any suitable marker currently used in conventional EAS systems. For example, the marker 12 may contain a resonator strip produced from an amorphous metal alloy that has a non-crystalline structure, resulting in unique magnetic properties. This resonator strip is then aligned atop a magnet, which causes the resonator strip to vibrate when the marker is exposed to the exciter pulse transmitted by the transmitter at a frequency for which the resonator strip is produced. After the transmitter stops transmitting, the resonator strip inside the marker 12 will continue to vibrate at the same frequency as the exciter pulse. This example of the marker 12 can be in either a tag form, which has a hard case and is reusable, or a label form, which is generally used once and deactivated at the point of sale. These markers 12 can include the Ultra.Strip® EAS labels, SensorStrip® II labels, SuperTag®, SuperTag® Combo, Ultra-Gator®, Mini Hard Tag, Soft Tag, and Ultra-Lock™ markers, among others. All of these markers are produced by Sensormatic Electronics Corporation of Boca Raton, Fla. The foregoing examples of markers are not intended to limit the scope of the invention and it should be understood that the system as described herein can be used with any EAS system requiring synchronization among multiple transmitter and receiver pairs located in close proximity.

A synchronization control circuit 22 is also provided as part of the EAS system 10. The synchronization control circuit 22 selectively enables and disables the operation of the transmitter and receiver circuit to minimize the occurrence of false detections of markers. Such false detections are particularly likely to occur in certain types of EAS systems where the characteristic response of the marker 12 is similar to the transmitted signal generated by the transmitter circuit 14. In order to minimize false alarming in the case where multiple transmitter/receiver pairs are used in relatively close proximity, suitable means must be provided to synchronize the transmit and receive windows of all such EAS systems.

Figure 2:
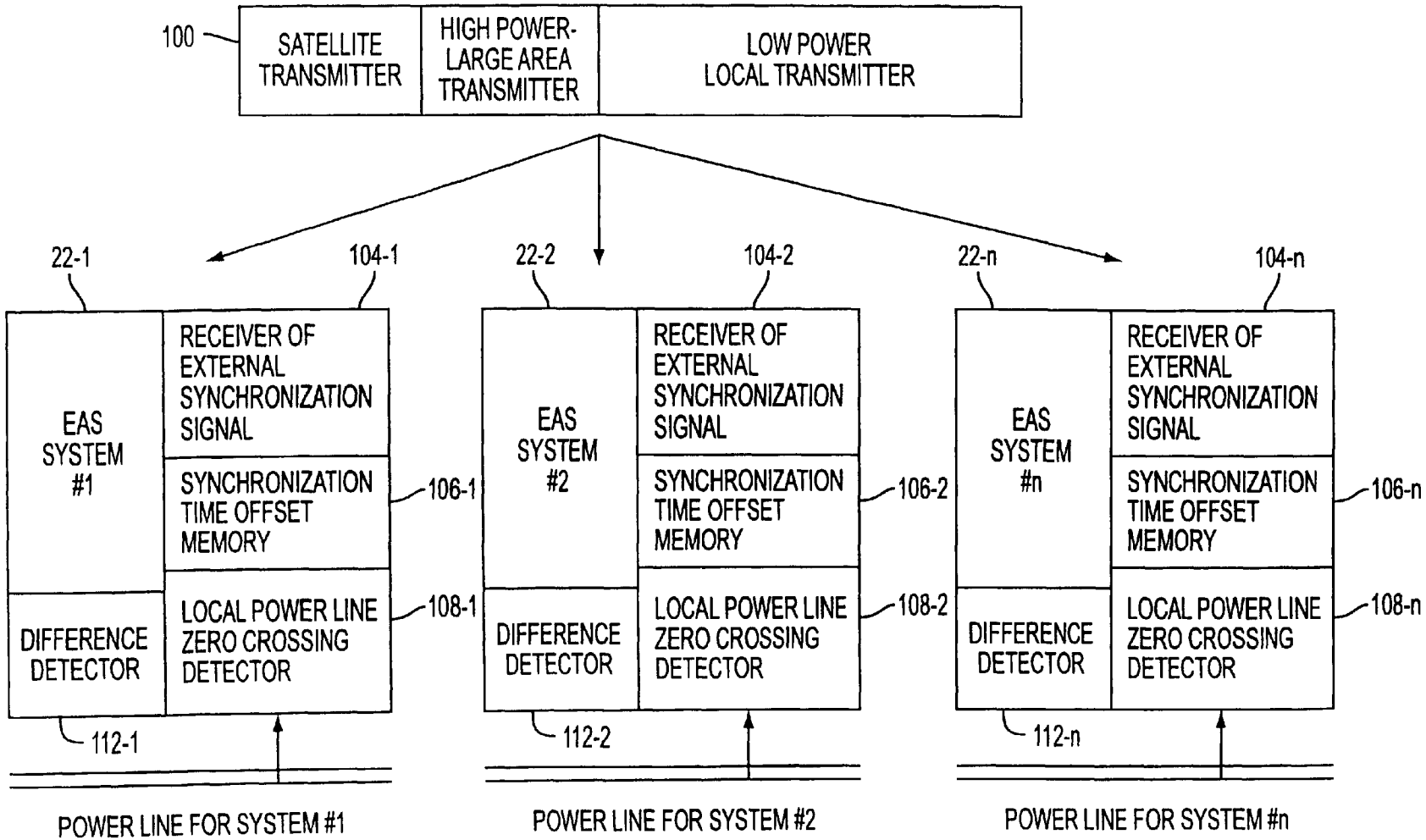
FIG. 2 is a detailed block diagram of the synchronization control system of FIG. 1.

FIG. 2 is a block diagram showing synchronization control circuits 22-1 through 22-n for a plurality of EAS systems receiving timing reference signals from a remote timing source 100. The synchronization control circuits 22-1 through 22-n each include a synchronization receiver 104-1 through 104-n for receiving in the EAS system an RF synchronization signal sent from the remote timing source 100; a synchronization time offset memory 106-1 through 106-n for storing a time difference between a received synchronization signal and a power line zero crossing reference time; and a local power line zero crossing detector 108-1 through 108-n for detecting power line zero crossings. The apparatus of the present invention also preferably includes a time difference detector 112-1 through 112-n for detecting a time difference between the RF synchronization signal and a zero crossing of a power line current or voltage. In this regard, It should be noted that a zero crossing of a power line voltage or current is described herein in some instances as a reference point when a power line signal is used as a timing reference. It should be noted, however, that the invention is not limited in this regard, and any particular phase of the power line signal could also be used as a reference point in place of the zero crossing.

The remote source 100 used in the present invention can be any source capable of sending a wireless RF signal to the receivers 104-1 through 104-n. The remote source 100 can use as a timing reference an absolute time signal or a local timer. In general, the remote source 100 can be either a satellite transmitter, a relatively high power transmitter of suitable design for transmitting over large geographic portions of the world, or a relatively low power transmitter designed for transmitting a timing signal over a much smaller areas, such as a shopping center. As used herein, the term absolute timing signal refers to any highly accurate time reference such as may be generated by atomic clocks and which is synchronized throughout the world. This means that the absolute timing signal received in the United States is, for all practical purposes, the same as the absolute timing signal received in distant locations, and vice versa. By comparison, a locally generated timing signal may or may not correlate to an absolute time reference.

In the present invention, when the remote source 100 is a satellite, the satellite is preferably one of the Global Positioning System (GPS) satellites. The GPS system satellites generally transmit on two L-band frequencies—1575.2 MHz and 1227.6 MHz, and have a master clock that is always kept within 1 microsecond of the U.S. Naval Observatory's Master Clock, which keeps time based on the Coordinated Universal Time (UTC) scale. Thus, when the remote source 100 is a GPS system satellite, the RF synchronization signals transmitted by the remote source 100 within the United States will generally be transmitted within 2 microseconds of one another (taking into account that one GPS satellite transmitted the RF synchronization signal may be 1 microsecond fast, while a second GPS satellite transmitting the RF synchronization signal may be 1 microsecond slow).

If the remote source 100 is a high power radio transmitter for coverage of large geographic areas, the radio transmitter used to transmit the RF synchronization signal is preferably the one of several such systems which are operated by government or private agencies in various areas of the world. For example, in North America, the WWVB radio station located in Fort Collins, Colo. can be used for the purposes described herein. The WWVB radio station is operated by the National Institute of Standards and Technology. The function of the station is to provide UTC timing information throughout the United States. At the station itself, time is kept within a 1 microsecond variation of the UTC time kept at the U.S. Naval Observatory, much like the timing frequency kept by GPS satellites. Thus, each of these examples would fall into the category of absolute timing signals.

Alternatively, if the remote source 100 is a local transmitter, it preferably uses a local timer as a reference signal. A local timing signal is sent to the synchronization control circuit of either one or a number of EAS systems 22-1 through 22-n in relatively close proximity in order to synchronize their operation. Thus, the local timer signal can be used, for example, to synchronize multiple EAS systems 10 placed in a large entrance or throughout a department store or a mall. It is generally desirable to limit the transmission range of source 100 to a relatively small area when a local timer is used. The local timing signal can be an internal electronic clock associated with the low power local transmitter, or it can be a time reference based on a power line signal at a specific power line outlet.

Significantly, the remote timing source 100 may be incorporated into a master EAS system which is designated for controlling the synchronization of a group of such EAS systems in close proximity. In this case, the local timing signal can be based on an internal clock provided as part of the master EAS system or a power line zero crossing measured at the master EAS system. Alternatively the local timing signal may be generated at the master EAS unit based upon a remote absolute timing reference. In any case, the master EAS system would serve as the remote timing source 100 and would transmit an RF signal to the remaining EAS systems which are to be synchronized.

Referring now to synchronization control circuits 22-1 through 22-n, it will be appreciated by those skilled in the art that the synchronization receivers 104-1 through 104-n can be any circuit that has the ability to receive and detect an RF synchronization signal. For example, a radio or satellite receiver, among other things, can be used for this purpose, provided that it has the ability to demodulate and, if necessary, decode an RF time reference signal. According to a preferred embodiment, each synchronization control circuit 22-1 through 22-n enables and disables its respective transmitter circuit and receiver circuit in a predetermined manner which is synchronized with the detected RF synchronization signal.

Figure 3:
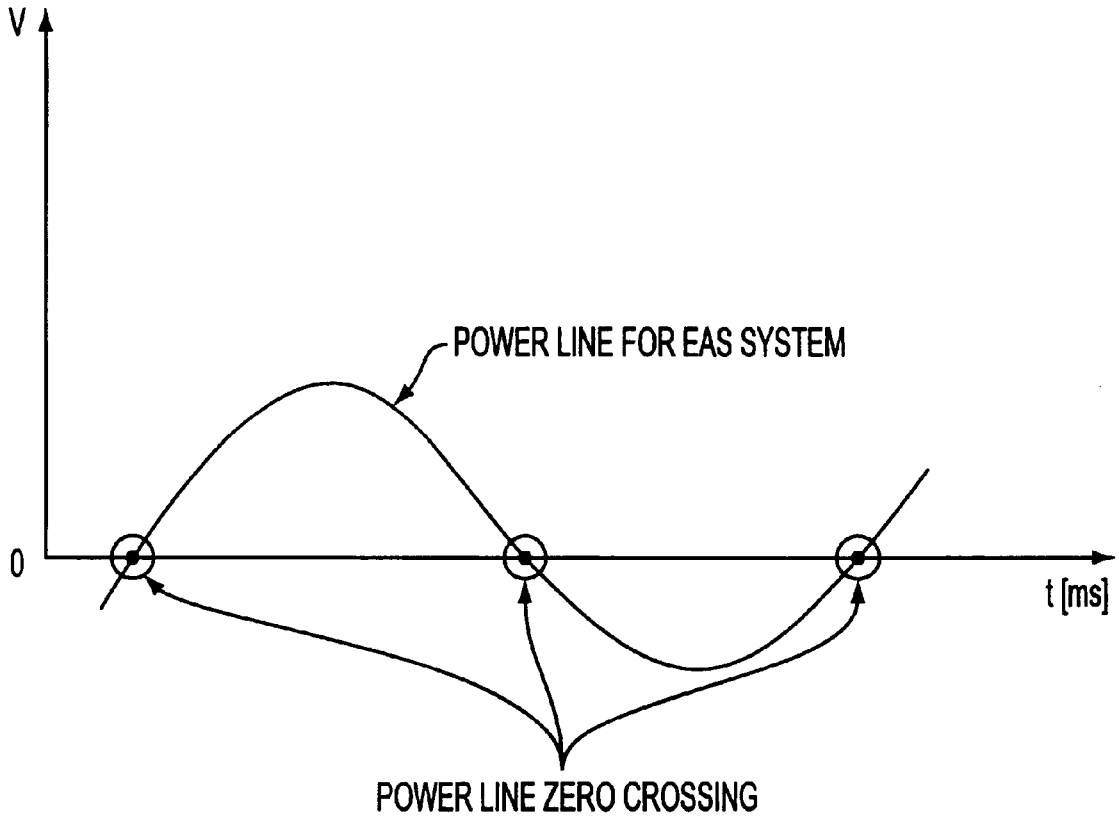
FIG. 3 is a diagram showing a power line signal for an electronic article surveillance system.

In the present invention, it is preferable that each synchronization control circuit 22-1 through 22-n also periodically detect a zero crossing of a local power line current or voltage in detector 108-1 through 108-n. Referring to FIG. 3, the detection of the zero crossing of the power line current or voltage attached to the EAS system, according to the present invention, is illustrated. After each periodic detection of the zero crossing by detector 108-1 through 108-n, the time difference detectors 112-1 through 112-n each determine the time difference between the the RF synchronization signal and the zero crossing of the local voltage or current of the power line attached that EAS system. This time difference data for each synchronization control circuit is preferably stored by the EAS system, in a memory 106-1 through 106-n, so that it may be subsequently accessed in the event that the RF synchronization signal is not detected. In the present invention, this memory is preferably non-volatile. This non-volatile memory prevents the stored time difference from being lost, such as from a temporary power outage.

Figure 4:
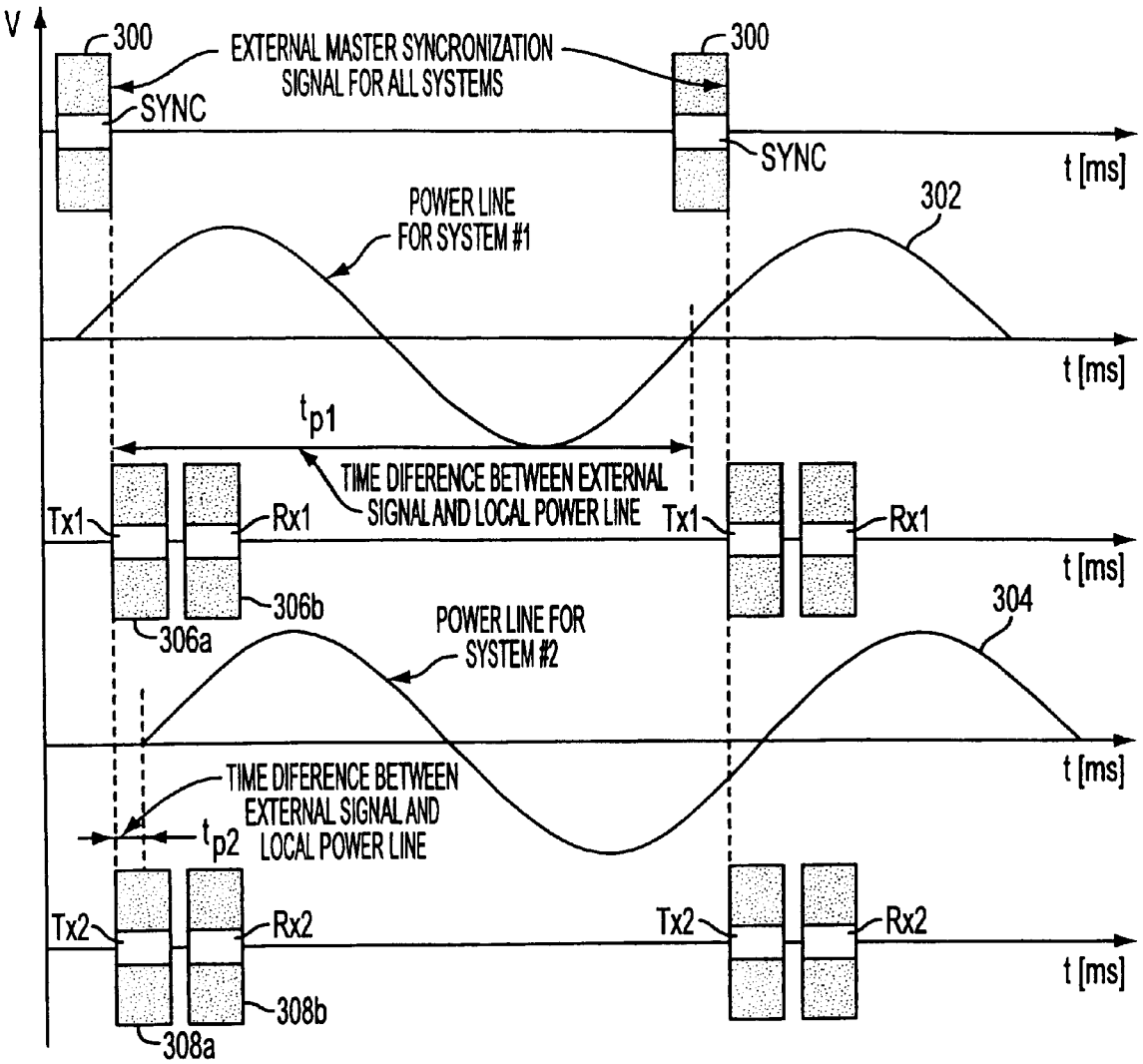
FIG. 4 is a timing diagram showing the operation of the system according to the invention.

FIG. 4 is a timing diagram which illustrates a preferred embodiment according to the present invention. FIG. 4 shows synchronization signals 300 from timing source 100 which are periodically received by a pair of synchronization receivers 104-1 and 104-2 corresponding to EAS systems 1 and 2 respectively. Using timing signals 300 as a point of reference, it can be seen that the relative phase of the power line voltage 302 for EAS system 1 is offset in time as compared to power line voltage 304 for EAS system 2. Consequently, if these two EAS systems were synchronized to the power line only, transmit and receive windows 306*a,* 306*b* could potentially overlap with transmit and receive windows 308*a* and 308*b,* thereby causing degraded performance or false alarming. However, because the transmit and receive windows are synchronized to the synchronization signal 300, no such overlap occurs and the degraded performance/false alarming problem is avoided. Moreover, by calculating the time difference signal $t_{p1}$ and $t_{p2}$, between the external signal and the local power line, the system can calculate a timing correction value for use when the synchronization signal 300 is temporarily not detected for some reason. This failure of the RF synchronization signal to be received can be caused by any number of problems, such as interference, a faulty transmission of the RF signal or a faulty receiver.

If timing signal 300 is not detected, then each synchronization control circuit 104-1 and 104-2 can enable and disable transmit and receive windows 306*a,* 306*b,* 308*a,* and 308*b* at a time based on the measured power line zero crossing plus or minus a correction factor determined by the time difference signals $t_{p1}$ and $t_{p2}$. For example, in FIG. 4, transmit window 306*a* could open at a time determined by the equation $t=P-t_{p1}$ where P is equal to the period of the power line voltage signal and t is the time delay after the zero crossing when the transmit window would open. Those skilled in the art will recognize that the invention is not limited in this regard and the time offset could be used in alternative ways to ensure that the transmit and receive windows for the various EAS systems are properly synchronized.

In the present invention, the failure of the RF synchronization signal to be received is handled by having every EAS system requiring synchronization to periodically detect a zero crossing of a power line current or voltage. After such periodic detection of the zero crossing by the EAS system, a calculation is made to determine the time difference between the receipt of the RF synchronization signal by the EAS system and the detection of the zero crossing by the EAS system. This time difference is then preferably stored in memory 106-1 through 106-n, so that it may be accessed if necessary. In the present invention, this memory is preferably non-volatile so that the calculated time difference is not lost, such as from a temporary power outage, among other things. Subsequently, if the RF synchronization signal is not detected, the synchronization control circuit can continue to maintain synchronization based on the power line zero crossing and the offset time relative to past synchronization signals.

In an alternative embodiment of the invention, rather than relying upon the RF synchronization signal in all instances to trigger the EAS transmitter, the system can use the calculated value determined by the equation $t=P-T_{pn}$ where n refers to each of the EAS systems which are to be synchronized. In this embodiment, the value of $T_{pn}$ can be continuously updated based upon the RF synchronization signal received by the particular EAS system.

The value Tpn or the calculated offset for the stored synchronization signal which is stored in memory 106-1 through 106-n can be based directly upon a measured offset value. In the alternative, this value can be determined based upon a moving average or some other smoothing function. For example, a moving average based on 4 or 5 power line cycles can be used for this purpose. Such an approach is advantageous as it minimizes the effect of jitter and noise which may be associated with the detected power line zero crossing, while ensuring that any significant power line phase changes are properly accounted for.

The detection of the time difference for each EAS system solves the problem of phase variations arising from differences in the loads on the power lines attached to each individual EAS system. Since the time difference is periodically detected for each EAS system, the effect of changes in the loads on the power line attached to each EAS system is neutralized as well. Thus, if the load attached to EAS system is modified from, for example, power drains from new or additional sources attached to that load, this change in the load can be accounted for in a future detection of the time difference.

In the present invention, it is preferable that the link between the remote timing source 100 and each EAS system receiving the RF synchronization signal be reliable. Failure to maintain a link can potentially lead to the EAS systems in close proximity falling out of phase from one another—even with the time difference measurement. If the load on the power line changes for the EAS system, for which the link between the sending and receiving of the RF synchronization signal is broken for an extended period of time, the time difference that is stored in memory potentially no longer properly identifies the predetermined time after the zero crossing of the power line current or voltage to begin transmitting the exciter pulse. This improper time difference can lead to reduced sensitivity and false detection of the marker by the EAS systems.

In the present invention, it is also preferable that the RF synchronization signal received by said EAS system be encoded. Encoding the RF synchronization signals sent by the remote source prevents the mistaken classification by the EAS system of alternative RF signals as synchronization signals. Encoding is particularly preferable in areas with a high degree of radio or microwave transmission traffic where an EAS system could easily receive a signal unintended for that system and, as a result, prematurely transmit an exciter pulse. if this happens, the prematurely transmitting EAS system will be out of phase with other EAS systems in close proximity and may cause a reduction in the efficacy or sensitivity of those systems.

What is claimed is:

1. A method for synchronizing the operation of a plurality of EAS systems, comprising:

receiving in said plurality of EAS systems an single RF synchronization signal from a remote source;

detecting a time difference between said RF syncyronization signal and zero crossing of at least one of a power line current and voltage and storing said difference in a memory;

in response to receiving said RF synchronization signal, transmitting in each of said EAS systems a synchronized exciter pulse for exciting a remotely located identification marker; and a predetermined time after transmitting said exciter pulse, enabling in each of said EAS systems a receiver for detecting a characteristic response of said indentification marker.

2. The method according to claim 1, further comprising transmitting said exciter pulse a predetermined time after detecting said zero crossing, said predetermined time determined based on said time difference.

3. The method according to claim 1, wherein said remote source is an RF transmitter equipped on a second EAS system.

4. The method according to claim 3, wherein said RF synchronization signal generated by said EAS system is synchronized to a zero crossing of at least one of a power line current and voltage.

5. The method according to claim 1, wherein said remote source is a geographically remote radio transmitter system.

6. The method according to claim 5, wherein said remote source is a satellite.

7. The method according to claim 6, wherein said satellite is a global positioning system satellite.

8. The method according to claim 5, wherein said remote source is a radio terrestrial transmitter.

9. The method according to claim 5, wherein the RF synchronization signal is an absolute timing signal.

10. The method according to claim 1, wherein said RF synchronization signal is a local timing signal.

11. The method according to claim 1, wherein said RF synchronization signal received by said EAS system is encoded.

12. An apparatus for synchronized operation of a plurality of EAS systems, comprising:

a plurality of EAS system, each having a receiver for receiving a same RF synchronization signal sent from a remote source, a transmitter for transmitting an exciter pulse for exciting an indentification marker in response to said receiver receiving said RF synchronization signal, an exciter pulse receiver enable a predetermined time after transmitter transmits said exciter pulse receiver enabled a predetermined time after said transmitter transmits said exciter pulse, for detecting a characteristic response of said indentification marker, and a local power line zero crossing detector and a difference detector for detecting a time difference between said RF synchronization signal and a zero crossing of at least one of a power line current and voltage.

13. The apparatus according to claim 12, further comprising a memory for storing said time difference, and wherein the transmitter transmits said exciter pulse a predetermined time relative to said zero crossing if said receiver does not subsequently receive said RF synchronization signal, said predetermined time calculated based upon said time difference.

14.The apparatus according to claim 12, wherein said remote source is a second EAS system.

15. The apparatus according to claim 12, wherein said RF synchronization signal is triggered by a zero crossing of at least one of a power line current and voltage.

16. The apparatus according to claim 12, wherein said remote source is a satellite.

17. The apparatus according to claim 12, wherein said remote source is a geographically remote radio transmitter.

18. The apparatus according to claim 17, wherein the remote source transmits an absolute timing signal.

19. The apparatus according to claim 12, wherein said RF synchronization signal is a local timing signal.

20. The apparatus according to claim 12, wherein said RF synchronization signal received by said EAS system is encoded.

21. A method for synchronized operation of a plurality of EAS systems comprising:

receiving in each said plurality of EAS systems a same RF synchronization signal;

processing said RF synchronization signal in each of said plurality of EAS systems to determine a time offset relative to a predetermined angle of at least one of a power line voltage and current for each said EAS systems;

storing in each said EAS system a time offset in a memory location; and transmitting in each of said EAS systems an exciter pulse for exciting a remotely located identification marker in accordance with said time offset.

* * * * *

UNITED STATES PATENT AND TRADEMARK OFFICE

CERTIFICATE OF CORRECTION

PATENT NO. : 6,320,507 B1
DATED : November 21, 2001
INVENTOR(S) : Strzelec et al.

It is certified that error appears in the above-identified patent and that said Letters Patent is hereby corrected as shown below:

Claim 1,
Line 5, replace "indentification" with -- identification --.

Claim 12,
Line 38, replace "indentification" with -- identification --.
Lines 40-42, delete "enable a predetermined time after transmitter transmits said exciter pulse receiver" as it is duplicated incorrectly.
Line 44, replace "indentification" with -- identification --.

Signed and Sealed this

Sixteenth Day of April, 2002

*Attest:*

*Attesting Officer*

JAMES E. ROGAN
*Director of the United States Patent and Trademark Office*